United States Patent [19]

von Dreusche, Jr.

[11] 4,050,389

[45] Sept. 27, 1977

[54] METHOD AND APPARATUS FOR INCINERATING WASTE MATERIAL

[75] Inventor: Charles F. von Dreusche, Jr., Ramsey, N.J.

[73] Assignee: Nichols Engineering & Research Corporation, Belle Mead, N.J.

[21] Appl. No.: 706,637

[22] Filed: July 19, 1976

[51] Int. Cl.[2] ..... F23G 5/04; F27B 9/22

[52] U.S. Cl. ..... 110/12; 202/117; 432/139

[58] Field of Search ..... 110/12; 202/117; 432/139, 144

[56] References Cited

U.S. PATENT DOCUMENTS

| | | | |
|---|---|---|---|
| 3,379,622 | 4/1968 | von Dreusche, Jr. | 202/117 |
| 3,861,332 | 1/1975 | Itasaka | 110/13 |
| 3,905,757 | 9/1975 | von Dreusche, Jr. | 432/18 |
| 3,958,920 | 5/1976 | Anderson | 110/12 |
| 3,968,756 | 7/1976 | Yamada | 110/12 |

*Primary Examiner*—Kenneth W. Sprague

*Attorney, Agent, or Firm*—Edwin T. Grimes

[57] ABSTRACT

A method and apparatus for incinerating waste material in a multiple hearth furnace having a plurality of vertically spaced hearths wherein waste material is introduced to the furnace at the top thereof and moves downwardly in a generally serpentine fashion moving alternately inwardly and outwardly across the hearths and is discharged at the bottom of the furnace, and including the steps of introducing towards the lowermost hearth thereof air in a quantity less than that theoretically required for complete combustion of the material being processed, thereafter at successively higher hearths ascertaining the temperature at each hearth and adding air thereto in quantities only sufficient to support combustion thereon, and on each hearth in the middle portion of the furnace adding only enough air to each hearth so as to maintain the temperature on that hearth under a maximum predetermined limit, and on the hearths towards the top of the furnace reducing the quantity of air added, and thence discharging the exhaust gases at the top of the furnace.

15 Claims, 1 Drawing Figure

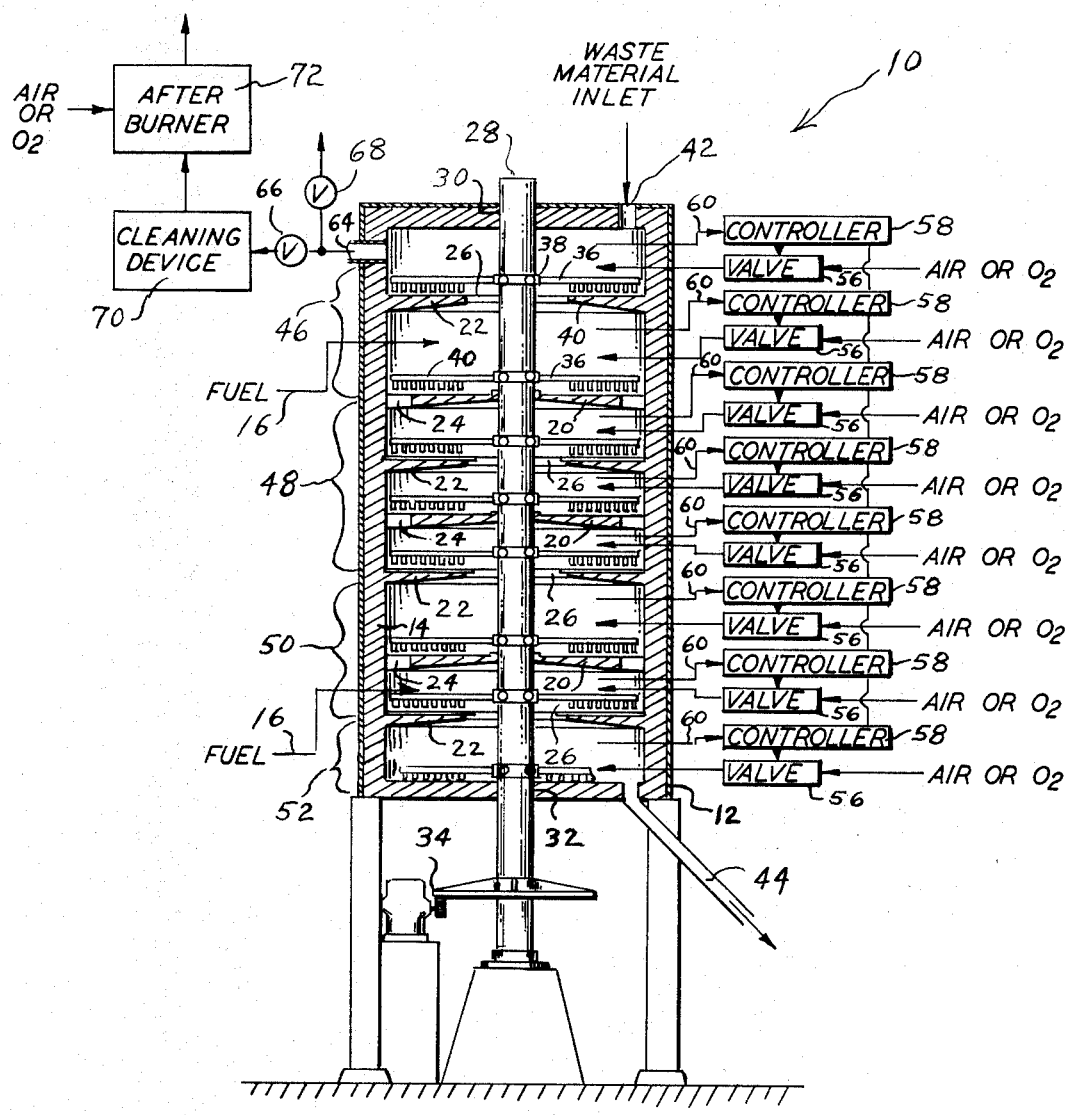
AIR OR O2
AFTER BURNER
72
CLEANING DEVICE
70
68
66
64
WASTE MATERIAL INLET
10
28
30
42
60
CONTROLLER
58
VALVE
56
AIR OR O2
46
FUEL
16
48
50
52
12
34
32
44
26
38
36
22
40
24
20
14

METHOD AND APPARATUS FOR INCINERATING WASTE MATERIAL

BACKGROUND OF THE INVENTION

This invention relates to incinerators and more particularly to method and apparatus for continuously incinerating waste material. The invention is particularly adapted, among other possible uses for incinerating sewage sludge, municipal, industrial or community garbage, trash or refuse, for example.

Many different types of incinerators have been employed for such use including, for example, the well known Herreshoff type furnace, which is a multiple hearth type furnace having a plurality of vertically spaced hearths. In such installations the waste material is introduced to the furnace at the top and moves downwardly in a generally serpentine fashion moving alternately inwardly and outwardly across the hearths and is discharged at the bottom. Problems have been encountered with such furnaces due to the fact that the middle hearths tended to overheat beyond the structural design limits of the furnace. Heretofore, in order to overcome this problem it was thought necessary to add more air or oxygen at the bottom of the furnace. Thus, such a system frequently operated with as much as 100% excess air added at the bottom of the furnace in order to cool the central portion thereof to workable limits. I have found that such excess air tends to entrain or carry with it deleterious matter into the exhaust gases from the furnace. The problem of preventing air pollution in our present environment has become critical and, hence, large and expensive scrubbers or other exhaust gas cleaning devices were required.

The present invention overcomes the aforementioned problems in a new and improved manner, as will become apparent as the description proceeds.

SUMMARY OF THE INVENTION

In order to accomplish the desired results, I provide in one form of my invention a new and improved method of incinerating waste material in a multiple hearth furnace having a plurality of vertically spaced hearths wherein the waste material is introduced to the furnace at the top thereof and moves downwardly in a generally serpentine fashion moving alternately inwardly and outwardly across the hearths and is discharged at the bottom of the furnace. The method is characterized by the steps of introducing towards the lowermost hearth thereof air in a quantity less than that theoretically required for the complete combustion of the material being processed, and thereafter at successively higher hearths ascertaining the temperature at each hearth and adding air thereto in quantities only sufficient to support combustion thereon. On each hearth in the middle portion of the furnace only enough air is added to each hearth to maintain the temperature on that hearth under a maximum predetermined limit, which may be for example of the order of about 1800° F, and on the hearths towards the top of the furnace reducing the quantity of air added, and thence discharging the exhaust gases at the top of the furnace.

According to one aspect of the invention, the method further comprises the steps of passing the exhaust gases from the top of the furnace to a hot gas cleaning device, and then passing the gases to an afterburner while simultaneously adding air thereto. According to another aspect thereof the invention includes the step of reducing the addition of air to the next adjacent upper hearth in the upper middle portion of the furnace when the temperature of a hearth falls below the maximum predetermined limit and the flow of air to that hearth is at its maximum. In the lower middle portion of the furnace, the addition of air to the next adjacent lower hearth is reduced when the temperature of a hearth falls below the maximum predetermined limit and the flow of air to that hearth is at its maximum.

In another form of my invention, I provide a new and improved apparatus for incinerating waste material, which includes in combination a multiple hearth furnace having a plurality of vertically spaced hearths, a rotatable center shaft extending through the center of the furnace and passing through each hearth, a plurality of spaced rabble arms secured to the center shaft and extending radially outwardly over each hearth, alternate hearths having drop holes disposed towards the center shaft and and the other hearths having drop holes disposed towards the outer periphery thereof. In addition, the furnace has an upper material inlet and a lower material dispensing outlet, and an upper exhaust gas outlet. Nozzle means are provided for introducing air towards the lowermost hearth in a quantity less than that theoretically required for complete combustion of the material being processed, and means are disposed on successively higher hearths for ascertaining the temperature at each hearth and for adding air thereto in quantities only sufficient to support combustion thereon. Means are disposed on each hearth in the middle portion of the furnace for adding only enough air to each hearth to maintain the temperature on that hearth under a predetermined maximum limit, and means are disposed towards the top of the furnace for reducing the quantity of air added. According to one aspect of the invention nozzle means are provided for adding fuel to the furnace at predetermined hearths towards the top of the furnace, and according to another aspect thereof a hot gas cleaning device is provided for receiving the exhaust gases from the furnace outlet, and an afterburner serves to burn any hydrocarbons left over in the furnace exhaust gas. According to still another aspect of the invention, means are provided for reducing the addition of air to the next adjacent upper hearth in the upper middle portion of the furnace, when the temperature of a hearth falls below the maximum predetermined limit and the flow of air to that hearth is at its maximum. In the lower middle portion of the furnace, the addition of air to the next adjacent lower hearth is reduced when the temperature of a hearth falls below the maximum predetermined limit and the flow of air to that hearth is at its maximum.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which the disclosure is based may readily be utilized as a basis for the designing of other methods and apparatus for carrying out the several purposes of the invention. It is important, therefore, that the claims be regarded as including such equivalent methods and apparatus as do not depart from the spirit and scope of the invention.

Specific embodiments of the invention have been chosen for purposes of illustration and description, and are shown in the accompanying drawings, forming a part of the specification.

BRIEF DESCRIPTION OF THE DRAWINGS

The FIGURE is a diagrammatic illustration, partially in axial, sectional elevation of a system for incinerating waste material according to my invention.

DETAILED DESCRIPTION OF THE PREFERRED EMBODIMENTS

In the system illustrated in the drawing, there is shown a multiple hearth furnace 10 of generally cylindrical configuration. Such a furnace may be of the type, for example, as described in detail in my U.S. Pat. No. 3,905,757 issued Sept. 16, 1975. The furnace is constructed of a tubular outer steel shell 12, which is lined with fire brick or other similar heat resistant material 14. The furnace is provided with a plurality of burner nozzles 16, with one or more being provided on one or more of the hearths, as necessary, for initial start-up operation and for controlling the temperatures within the different regions of the furnace to carry out the particular processing desired. Any suitable type of fuel may be provided to the burners.

The interior of the furnace 10 is divided, by means of hearth floors 20 and 22, into a plurality of vertically aligned hearths, the number of hearths being preselected depending on the particular process being carried out. Each of the hearth floors is made of refractory material and is preferably of slightly arched configuration to be self-supporting within the furnace. Outer peripheral drop holes 24 are provided near the outer shell 12 of the furnace, and central drop holes 26 are formed in alternate hearth floors 22, near the center of the furnace. While the drawing shows the uppermost, or first, hearth as being an in-flow hearth, it will be appreciated that the concepts of my invention apply equally well to a furnace having an out-flow first hearth.

As illustrated in the drawing, a rotatable vertical center shaft 28 extends axially through the furnace 10 and is secured by upper bearing means indicated at 30 and lower bearings means 32. This center drive shaft is rotatably driven by an electric motor and gear drive 34, provided for the purpose. A plurality of spaced rabble arms 36 are mounted on the center shaft 28, as at 38, and extend outwardly in each hearth over the hearth floor. The rabble arms have rabble teeth 40 formed thereon which extend downwardly nearly to the hearth floor. The rabble teeth are inclined with respect to the longitudinal axis of their respective rabble arms so that as the rabble arms 36 are carried around by the rotation of the center shaft 28, the rabble teeth 40 continuously rake through the material being processed on the associated hearth floor and gradually urge the material toward the drop holes 24 and 26 in the hearth floors.

The material to be processed enters the top of the furnace at an inlet 42 and passes downwardly through the furnace in a generally serpentine fashion alternately inwardly and outwardly across the hearths and is discharged at the bottom of the furnace, as indicated at 44.

In effect, the furnace is divided into four zones. However, the zones are not finely segregated, but vary depending on the characteristics of the material being processed. For example, when processing sewage sludge, the first or upper zone 46, consisting of the first several hearths is a drying zone, and the second zone 48 consisting of the next several hearths is a charring or volatile burnig zone. The third zone 50 is a fixed carbon burning zone, and the fourth zone 52 is an ash cooling zone.

Heretofore, in order to support combustion, air was added at the bottom of the furnace. It will be appreciated that the hottest part of the furnace is in the central portion thereof, ie., in the lower portion of zone 48 and in the upper portion of zone 50. Problems were encountered due to the fact that these middle hearths tended to overheat beyond the structural design limits of the furnace. In order to overcome this problem, it was thought necessary to add more air or oxygen at the bottom of the furnace. Thus, such a system frequently operated with as much as 100% excess air (above that required for supporting combustion) being added at the bottom of the furnace in order to cool the central portion thereof to workable limits. As pointed out hereinbefore, such excess air tended to entrain or carry with it deleterious matter into the exhaust gases from the furnace. Moreover, this excess air meant that there was a large quantum of exhaust gases being discharged from the furnace, which has to be further processed as by scrubbers or other gas cleaning devices in order to meet the prevailing air pollution standards.

According to the present invention, one or more air nozzles 54 are provided for particular hearths, as necessary. The flow of air through the nozzle is controlled by a valve 56 actuated by a controller 58, which has an input from a temperature sensor or thermocouple 60 and another input 62 from the controller for the next adjacent hearth thereabove.

In operation, according to my invention, less air than that theoretically required for combustion is added through the nozzle 54 in the lowermost hearth, which may be, for example, 75% of that theoretically required. Thereafter, at each successive hearth, the temperature thereof is ascertained by the thermocouple 60 so that the controller 58 only allows enough air to enter that hearth as is required to support combustion to the extent necessary to maintain the predetermined temperature. In the fixed carbon burning zone 50 and in the charing or volatile burning zone 48, the controller 58, as instructed by the thermocouple 60, only allows enough air to pass through the valve 56 and out the nozzle 60 as to maintain the temperature on these hearths below that allowed by the structural characteristics of the furnace, which may be, for example, of the order of about 1800° F. Thus, these hearths are cooled by means of operating in a starved air or oxygen atmosphere, i.e., less than that required for complete combustion, as distinguished from the prior art installations wherein cooling was effected by means of excess air smothering the combustion. In the middle hearths of the furnace, when the temperature drops below a predetermined temperature, i.e., 1800° F, as registered by the thermocouple, the valve 56 will open to allow more air to enter the furnace to increase the rate of combustion up to the predetermined limit. It will be appreciated that, moving upwardly in the furnace, in some hearth in the second zone the temperature will fall below the predetermined temperature limit, but the controller will already be at maximum flow. This information is inputted via coupling 62 to the controller 58 of the next adjacent hearth thereabove so that the controller of the next adjacent upper hearth will no longer call for maximum air flow, but will reduce the flow thereof. Also, in same hearth in the third zone the temperature will fall below the predetermined temperature limit, and the controller will be at maximum flow. This imfornation is inputted via coupling 62 to the controller 58 of the next adjacent hearth therebelow so that the controller of the next adjacent lower hearth will no longer call for maximum air flow, but will reduce the flow thereof. Near the top of the furnace, the addition of air is very limited or discontinued altogether or else there will be excess air flowing out the exhaust outlet 64. If the temperature in the upper hearths in the drying zone 46 falls below a minimum drying level such as about 500° F, for example, fuel can be added by means of the burner nozzle 16 to maintain the temperature at this level to effect the desired drying of the incoming material.

It will thus be appreciated that the quantity of excess air mixed with the exhaust gases leaving the furnace through the outlet 64 is substantially reduced as compared to prior art systems, and hence the size of the subsequent cleaning devices, such as the scrubber, needed to process this exhaust gas has been substantially reduced. In addition, since the burning step, particularly the fixed carbon burning, has been lowered in the furnace, fewer solid particles are entrained in the upward flow gases at the top of the furnace. Hence, the organic vapors burn at a lower level in the furnace so that they are more apt to burn-out before reaching the top of the furnace and going out the exhaust outlet 64.

It will be further appreciated that the fuel employed by the burners 16 may be of any suitable type, such as oil, natural gas, or even some types of trash may be added toward the center of the furnace.

As an example, in the case of sewage sludge, the sludge entering the furnace at 42 contains from about 25% to about 40% solids and, hence, there is little or no fuel left in the exhaust gases so that the valve 66 is closed and the valve 68 is open whereby the gases pass directly to the subsequent gas cleaning device, not shown. In the event that the sludge entering the furnace at 42 is relatively dry, there may be hydrocarbons left over in the exhaust gas leaving the outlet 64. In this case the valve 68 is closed and the valve 66 is opened so that the exhaust gases flow to a gas cleaning device 70, which may be of any conventional type such as a hot cyclone, electrostatic precipitator, or hot mechanical filter, for example. Thence, the exhaust gases are passed to an afterburner 72 wherein air is added to complete the combustion. This system has several advantages as the excess air is added in the afterburner after the exhaust gases are physically separated from the solid material in the furnace so that they will not increase the carry-out or entrain flow of solid particles. Thus, the afterburner can be operated under turbulent conditions which provides cleaner and more efficient combustion of the gases, without entraining solids.

It will thus be seen that the present invention does indeed provide a new and improved system for incinerating waste material which generates less volume of off-gases to be cleaned for air pollution abatement, which limits the combustion of derived fuel and thereby saves fuel value for other uses, and which operates with lower temperature thereby prolonging equipment life.

Having thus described the invention with particular reference to the preferred forms thereof, it will be obvious to those skilled in the art to which the invention pertains, after understanding the invention that various changes and modifications may be made therein without departing from the spirit and scope of the invention, as defined by the claims appended hereto.

What is claimed is:

1. In a multiple hearth furnace having a plurality of vertically spaced hearths, wherein waste material is introduced to the furnace at the top thereof and moves downwardly in a generally serpentine fashion moving alternatively inwardly and outwardly across the hearths and is discharged at the bottom of the furnace, a method comprising the steps of introducing towards the lowermost hearth thereof air in a quantity less than that theoretically required for complete combustion of the material being processed, thereafter at successively higher hearths ascertaining the temperature at each hearth and adding air thereto in quantities only sufficient to support combustion thereon, and on each hearth in the middle portion of said furnace adding only enough air to each hearth as to maintain the temperature on that hearth under a maximum predetermined limit, and thence discharging exhause gases at the top of said furnace.

2. A method according to claim 1 wherein air in the quantity of the order of about 75% of that theoretically required for complete combustion is added at the bottom of the furnace.

3. A method according to claim 1 wherein the maximum predetermined temperature limit towards the middle of said furnace is of the order of about 1800° F.

4. A method according to claim 1 wherein said waste material is sewage sludge.

5. A method according to claim 1 further comprising the steps of passing the exhaust gases from the top of said furnace to a hot gas cleaning device, and then passing said gases to an afterburner while simultaneously adding air to said afterburner.

6. A method according to claim 1 further including the step of reducing the addition of air to the next adjacent upper hearth in the middle portion of the furnace when the temperature of a hearth falls below said maximum predetermined limit and the flow of air to that hearth is at its maximum.

7. A method according to claim 1 further including the step of reducing the addition of air to the next adjacent lower hearth in the lower middle portion of the furnace when the temperature of a hearth falls below said maximum predetermined limit and the flow of air to that hearth is at its maximum.

8. Apparatus for incinerating waste material comprising, in combination, a multiple hearth furnace having a plurality of vertically spaced hearths, a rotatable center shaft extending through the center of the furnace and passing through each hearth, a plurality of spaced rabble arms secured to the center shaft and extending radially outwardly over each hearth, alternate hearths having drop holes disposed towards the center shaft and the other hearths having drop holes disposed toward the outer periphery thereof, said furnace having an upper material inlet and a lower material dispensing outlet, and said furnace having an upper exhaust gas outlet, means for introducing towards the lowermost hearth thereof air in a quantity less than that theoretically required for complete combustion of the material being processed, means disposed on successively higher hearths for ascertaining the temperature at each hearth and means for adding air thereto in quantities only sufficient to support combustion thereon, means disposed on each hearth in the middle portion of the furnace for adding only enough air to each hearth to maintain the temperature on that hearth under a predetermined maximum limit.

9. Apparatus according to claim 8 further comprising means for adding fuel to said furnace at predetermined hearths towards the top of said furnace.

10. Apparatus according to claim 8 further comprising a hot gas cleaning device, means for passing the exhaust gases from said exhaust gas outlet to said cleaning device, an afterburner, means for passing said gases from said cleaning device to said afterburner, and means for adding air to said afterburner.

11. Apparatus according to claim 8 further comprising means for reducing the addition of air to the next adjacent upper hearth in the middle portion of the furnace when the temperature of a hearth falls below said maximum predetermined limit and the flow of air to that hearth is at its maximum.

12. Apparatus according to claim 8 further comprising means for reducing the addition of air to the next adjacent lower hearth in the lower middle portion of the furnace when the temperature of a hearth falls below said maximum predetermined limit and the flow of air to that hearth is at its maximum.

13. Apparatus according to claim 8 wherein said means disposed on each hearth in the middle portion of the furnace for adding only enough air to each hearth to maintain the temperature on that hearth under a predetermined maximum limit comprises an air inlet nozzle, a valve for controlling the flow of air through said nozzle, a control device for controlling said valve and a temperature sensor coupled to said control device.

14. Apparatus according to claim 13 further comprising coupling means interposed between the control device of one hearth with the control device of the next adjacent hearth for reducing the addition of air to the next adjacent upper hearth in the middle portion of the furnace when the temperature of a hearth falls below said maximum predetermined limit and the flow of air to that hearth is at its maximum.

15. Apparatus according to claim 13 further comprising coupling means interposed between the control device of one hearth with the control device of the next adjacent hearth for reducing the addition of air to the next adjacent lower hearth in the lower middle portion of the furnace when the temperature of a hearth falls below said maximum predetermined limit and the flow of air to that hearth is at its maximum.

* * * * *